United States Patent [19]

Kennel et al.

[11] Patent Number: 4,853,115

[45] Date of Patent: Aug. 1, 1989

[54] RAKE CLASSIFIER

[75] Inventors: George W. Kennel, White Plains, N.Y.; Matthew J. Rollberg, Stamford, Conn.

[73] Assignee: Dorr-Oliver Incorporated, Stamford, Conn.

[21] Appl. No.: 221,956

[22] Filed: Jul. 20, 1988

[51] Int. Cl.[4] ..... B03B 5/64; B03B 5/54

[52] U.S. Cl. ..... 209/173; 74/50; 198/737; 198/740; 209/462; 209/492

[58] Field of Search ..... 209/155, 173, 461, 462, 209/490, 492, 493, 507; 74/50; 198/737, 740; 210/523

[56] References Cited

U.S. PATENT DOCUMENTS

| | | | |
|---|---|---|---|
| 1,098,812 | 6/1914 | Lowden | 209/462 |
| 1,156,543 | 10/1915 | Nevill | 198/570 |
| 1,330,242 | 2/1920 | Donald | 209/462 X |
| 1,726,404 | 8/1929 | McConville | 209/462 |
| 1,870,409 | 8/1932 | Finney et al. | 209/462 |
| 2,191,743 | 2/1940 | Scott | 209/462 X |

*Primary Examiner*—Johnny D. Cherry
*Assistant Examiner*—Donald T. Hajec
*Attorney, Agent, or Firm*—Harold M. Snyder

[57] ABSTRACT

A rake classifier provides reciprocating movement using crank-mounted drive shafts to establish translatory forward movement as well as lifting and rearward movement of the rake structure.

9 Claims, 4 Drawing Sheets

RAKE CLASSIFIER

This invention is directed to a rake classifier having greatly simplified mechanical apparatus for achieving the reciprocating movement required of a rake classifier.

BACKGROUND OF THE INVENTION

The rake classifier was developed at the turn of the century for minerals classification, but it has since been successfully employed in the fields of lime slaking and washing and dewatering sewage grit. These prior art machines consist of a rectangular tank having an inclined bottom, a rake structure within the rectangular tank positioned close to the inclined bottom surface of the tank, and a mechanism for operating the rake to conform to a predetermined reciprocating path.

The feed material or slurry to be treated is fed into the lower end of the tank. The liquid in the tank only partially fills it, with the deepest part of the liquid at the lower end of the tank. An outlet is provided through the end or side wall at the lower end of the tank to control the liquid level therein. In operation, then, the lower portion of the inclined rake is below the liquid level in the tank, while the upper portion of the rake is above the liquid in the tank.

The reciprocating movement of the rake which has an up-and-over motion rapidly separates the feed slurry into two fractions: the fine slowly settling material and the coarse, quickly settling material. The fines fraction is buoyant due to specific gravity differential and the agitation produced by the reciprocating action of the rake. Being unable to settle, the fines pass out with the liquid as overflow at the lower end of the tank. The coarse fraction, in contrast, sinks rapidly to the bottom of the tank. Settled grit advances up the inclined bottom surface of the tank with each upward or forward stroke of the rake. The up-and-over motion of the rake, in which the rake is alternately raised and lowered at the ends of its stroke, transports and then releases fines from the coarse material and keeps them in suspension until they overflow. Coarse particles are drained on a "beach" portion of the inclined bottom surface above the liquid level in the tank before being discharged from the tank at its upper end by the last blade of the reciprocating rake.

The mechanism in the prior art which produces the characteristic up-and-over movement of the rake is a system of heavy gears, pinions and cranks driven by an electric motor, V-belt, drive and heavy-duty gearing. As many as fifty to seventy individual parts are employed in this system. Early rake classifiers are shown in U.S. Pat. Nos. 849,379 to J. Van N. Dorr; 1,024,647 to D. J. Nevill; and 1,156,543 to D. J. Nevill.

SUMMARY OF THE INVENTION

In accordance with the invention, a rake classifier having improved motor-driven means for imparting reciprocating movement to the rake structure is provided. The rake structure is positioned in the classifier tank and has two pairs of upstanding hangers connected to and spaced along the length of the rake structures. There is also provided a driven slot in each hanger element with the slots of each pair aligned, wheel means at the upper end of each hanger element capable of contacting guide surfaces provided on the walls of said tank to thereby support said rake structure, a drive shaft for each pair of hanger elements passing through the aligned slots of the paired hanger elements, rollers mounted on said drive shafts and positioned in said driven slots, one of said drive shafts connected at one end thereof by a crank element to the motor shaft of an electric motor with the other end of said drive shaft connected to a crank element which is in turn connected to a bearing shaft supported in a bearing mounted on the tank wall, a sprocket on said motor shaft, the other of said drive shafts connected at both ends thereof to crank means which are connected to bearing shafts supported in bearings mounted on said tank wall with one of these latter bearing shafts extending through said tank wall to carry a sprocket aligned with the sprocket on said motor shaft, and a chain in driving engagement with and extending between said sprockets. The drive shafts are driven synchronously by the chain drive mechanism.

DETAILED DESCRIPTION

Figure 1:
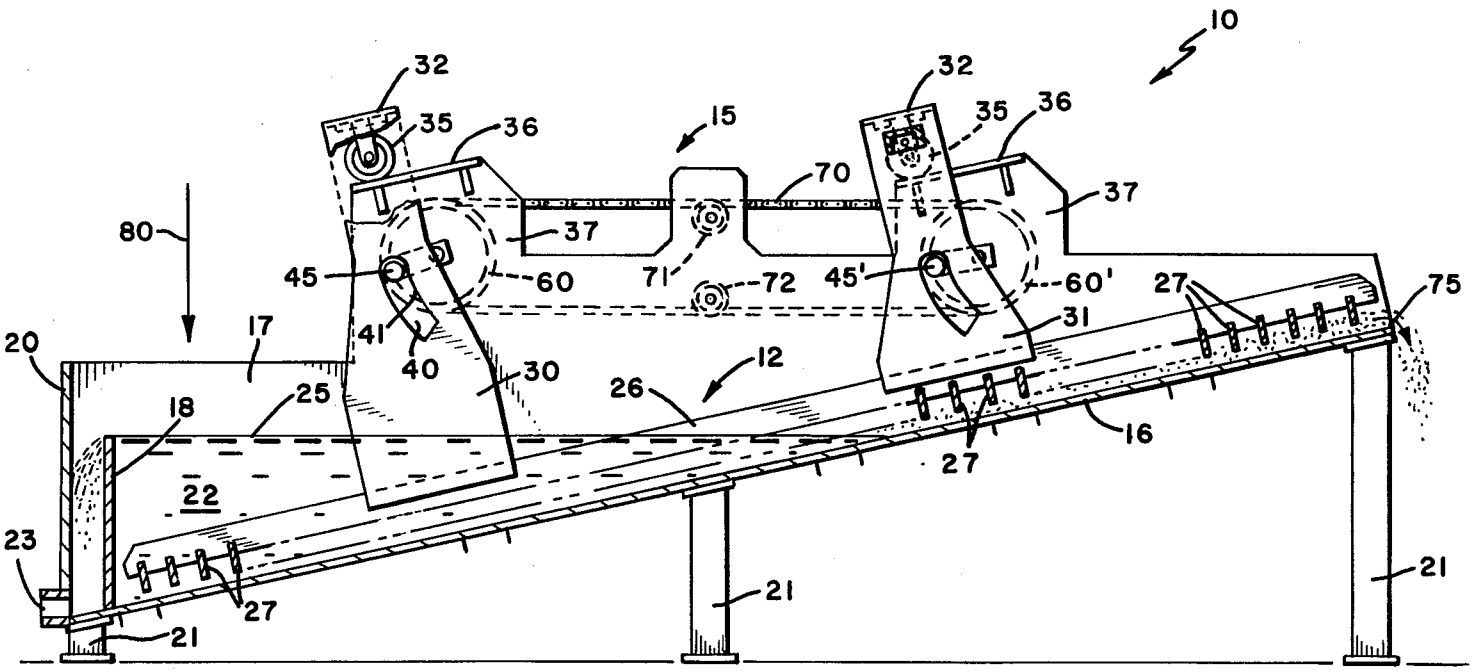
FIG. 1 is a side elevational view of the rake classifier of the invention with some portions in phantom showing.
Figure 2:
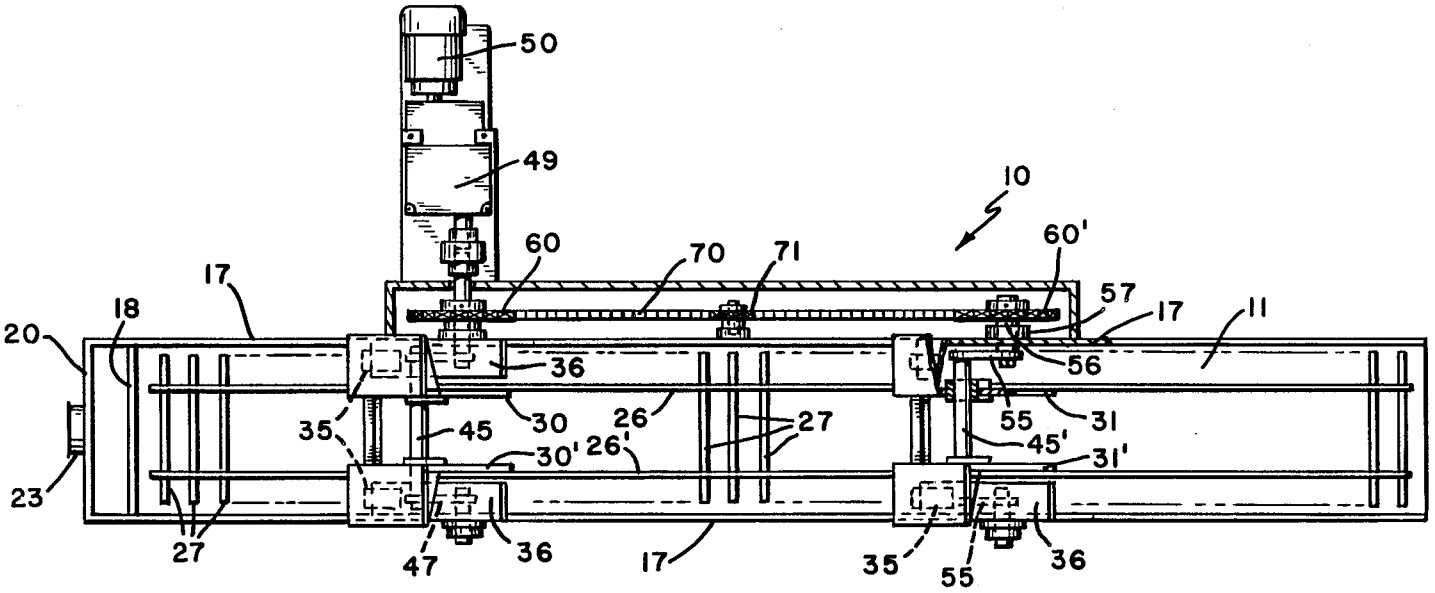
FIG. 2 is a plan view of the apparatus of the invention with some portions in phantom showing.
Figure 3:
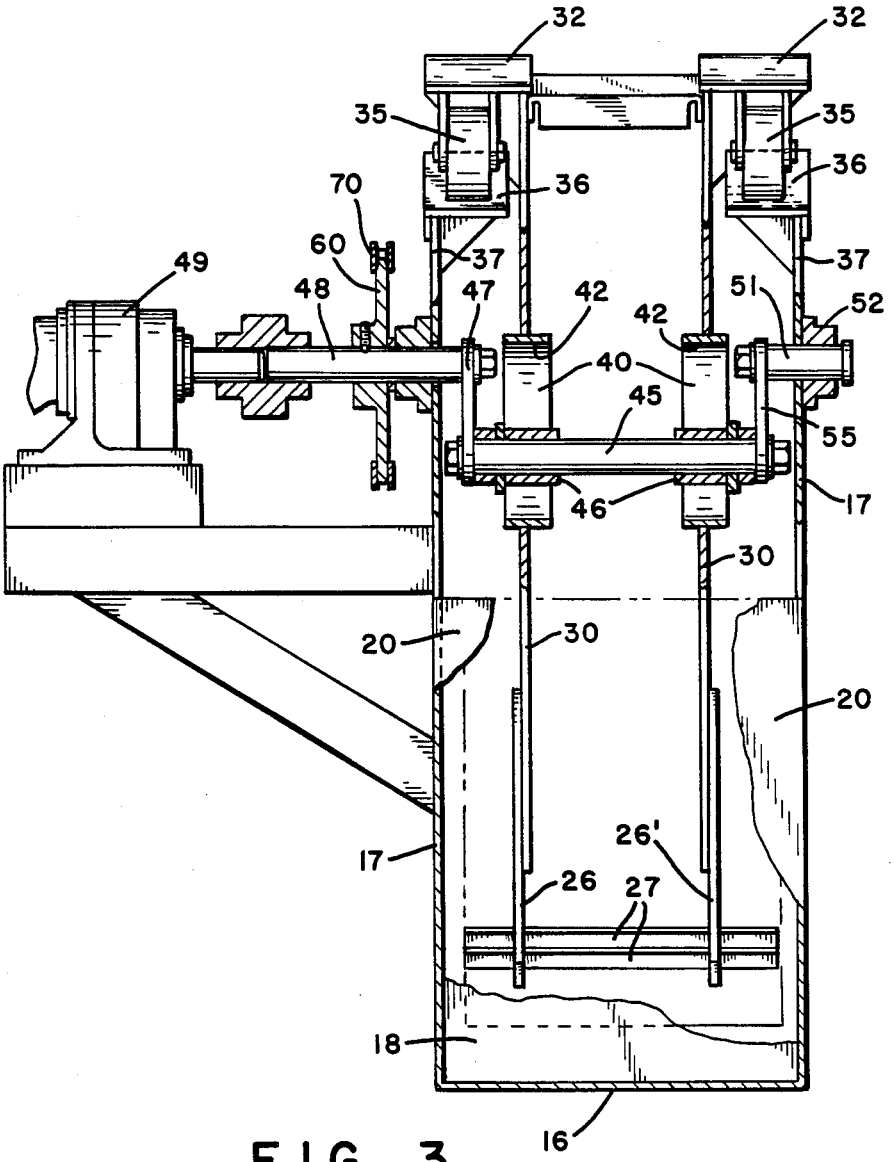
FIG. 3 is a front elevational view of the apparatus of the invention in part in section showing the motor-driven drive shaft.

Referring to FIGS. 1–4 there is illustrated a rake classifier 10 including a tank 11, a rake 12 and rake actuating means 15. The tank 11 has an inclined bottom 16, side walls 17 and end wall 20 with outlet 23 therein. The tank 11 is supported by piers 21 which contact inclined bottom 16. Within tank 11 at the lower end thereof a dam 18 is positioned parallel to end wall 20. As shown in FIG. 1, a slurry feed 22 partially fills tank 11 with the liquid level thereof indicated at 25.

The rake 12 includes a pair of elongated stringers 26 and 26' to which are attached a plurality of rake blades 27. Extending upwardly from stringers 26 and 26' to which they are connected by welding or other means are paired hangers 30, 30', 31 and 31'. The hangers each have at their upper ends a horizontal arm 32 which extends outwardly over the tank side walls 17. Each of the arms 32 has mounted thereunder a wheel 35 which is positioned to contact an inclined guide surface 36 connected or integral with an upward extension 37 of the side wall 17. The paired hangers each have curved driven slots 40 provided above liquid level 25 and below arms 32.

The rake actuating means 15 includes drive shafts 45 and 45' which each extend through the aligned driven slots 40 of paired hangers 30, 30' or 31, 31'. Rollers 46 are mounted on drive shafts 45, 45' at the point where the shafts pass through the driven slots 40 so that the rollers contact the slot edges when driving contact is made. One end of drive shaft 45 is connected to a crank element 47 which in turn is connected to a motor shaft 48 driven by electric motor 50 or by the motor through transmission 49. The sprocket 60 is mounted on motor shaft 48. Crank element 55 is connected between the other end of drive shaft 45 and a bearing shaft 51 supported in bearing 52 mounted on side wall 17.

The ends of drive shaft 45' are connected to crank elements 55 which are connected to bearing shafts 56 supported in bearings 57 mounted on wall 17. One of said bearing shafts 56 is of extended length outside tank 11 so that sprocket 60' may be mounted thereon in alignment with sprocket 60. A chain 70 is mounted in driving relation between sprockets 60 and 60' and chain 70 contacts idler sprockets 71 and 72 midway between sprockets 60 and 60'.

Figure 4:
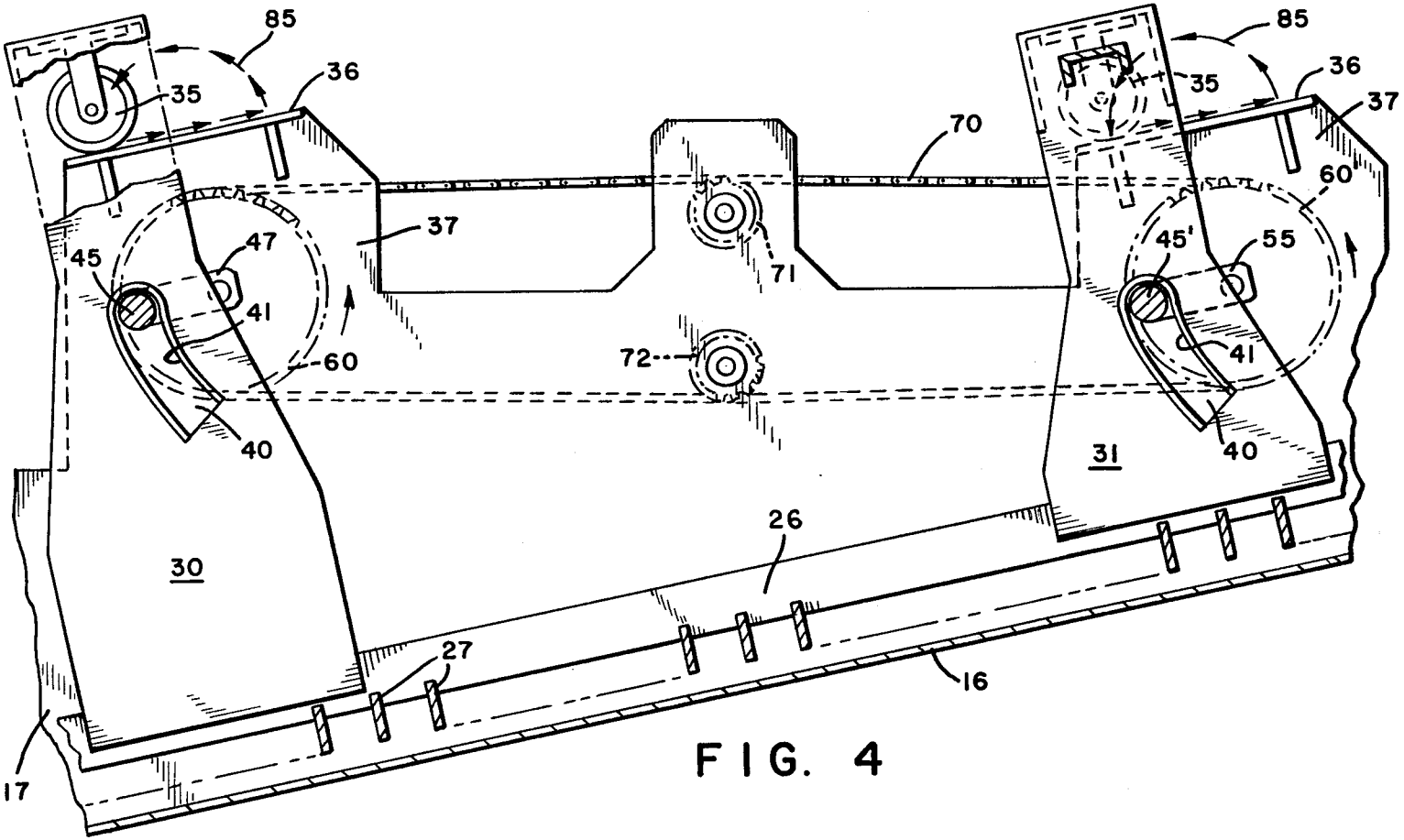
FIG. 4 is an enlarged partial side elevational view of the apparatus of the invention showing details of operation of the apparatus.

In operation, a feed slurry is introduced into tank 11 as indicated by arrow 80 (FIG. 1) and the tank 11 is filled to liquid level 25. As discussed above, the fines tend to remain suspended while the coarse fraction settles toward bottom 16 of tank 11 about the lower end of rake 12. The motor is started thereby, driving the drive shaft 45 into a counter clockwise direction and, through the medium of chain 70, causing drive shaft 45' to follow almost exactly the motion of drive shaft 45. This operation can be easily followed in FIG. 4, wherein it is seen that the movement of drive shafts 45 and 45' from the nine o'clock position illustrated will permit the hangers (and rakes) to drop of their own weight toward bottom 16 until stopped either by contact of wheels 35 with inclined guide surfaces 36 or by a compacted layer of coarse grit on bottom 16 temporarily preventing rake blades 27 from reaching the lowest point of travel permitted by wheels 35 and guide surfaces 36. The movement of drive shafts 45 and 45' at the same time brings them to bear against edge 41 of driven slots 40 so as to move hangers 30, 30' and 31, 31', and with them the entire rake structure, in a raking stroke which is parallel to inclined bottom 16. In this raking stroke the grit resting on bottom 16 is moved by blades 27 a finite distance upwardly on inclined bottom 16. The raking stroke ends when drive shafts 45 and 45' reach approximately the three o'clock position in their travel. At this point, forward motion ceases and the drive shafts 45 and 45' in continued movement now contact the upper edge surfaces 42 of slots 40 to lift the hangers and entire rake structure. The drive shafts continue toward the twelve o'clock position introducing a retrograde component of movement of the rake structure in addition to lifting the whole rake structure. The upward and rearward movement of rake blades 27 tends to release fines trapped in the coarse bed material and keeps them in suspension. As the drive shafts move from the twelve o'clock position to the nine o'clock position the rake structure moves rearwardly and drops down toward contact with the bed material. The movement of the wheels 35, and consequently the rake structure as a whole, is illustrated in FIG. 4 by the path delineated by arrows 85 along and above guide surface 36.

It will be understood that, as additional slurry is added to tank 11, liquid and suspended fines overflow dam 18 and this effluent leaves tank 11 through outlet 23. Each forward stroke of the rake advances the coarse material on bottom 16 up the inclined slope thereof. The grit is thus advanced above liquid level 25 onto the "beach" slope of bottom 16 where excess liquid drains back down into the slurry at the lower end of tank 11. Under continued raking in the "beach" region substantial dewatering of the grit occurs and the last rake blade discharges this semidried grit product over lip 75 from the rake classifier.

There has thus been provided a relatively simple mechanical arrangement for achieving the somewhat complicated reciprocating movement required of the rake structure in a rake classifier.

Although the present invention has been described in conjunction with preferred embodiments, it is to be understood that modifications and variations in the process may be resorted to without departing from the spirit and scope of the invention, as those skilled in the art will readily understand. Such modifications and variations are considered to be within the purview and scope of the invention and appended claims.

We claim:

1. A rake classifier comprising a tank having side and end walls, a rake structure, an electric motor having a motor shaft and motor-driven means for imparting raking movement to said rake structure, said rake structure positioned in said tank and having two pairs of upstanding hanger elements spaced along the length of said rake structure, said motor driven means comprising a driven slot in each hanger element with the slots of each pair aligned, a plurality of supporting guide surfaces with one of said guide surfaces adjacent each hanger element, means at the upper end of each hanger element for contacting said supporting guide surfaces, a drive shaft for each pair of hanger elements passing through said aligned driven slots, a crank element located on each end of said drive shafts, a plurality of bearing shafts fixed in said side walls, one of said crank elements joining one of said drive shafts to said motor shaft with the crank element at the other end thereof joining said drive shaft to a bearing shaft, the other of said drive shafts connected at both ends thereof to crank elements which are connected to bearing shafts mounted in said side walls, and means for driving said drive shafts in synchronism.

2. The rake classifier of claim 1 wherein said means for driving said drive shafts in synchronism is a chain drive mechanism.

3. The rake classifier of claim 1 wherein said means on each hanger element contacting supporting guide surfaces are wheels mounted thereon.

4. The rake classifier of claim 3 wherein said supporting guide surfaces are provided on the walls of said tank.

5. The rake classifier of claim 4 wherein rollers are mounted on said drive shafts and positioned in said driven slots to thereby provide contact between said drive shafts and said driven slots.

6. The rake classifier of claim 5 wherein the motor shaft and each of the bearing shafts is supported in a bearing mounted on said tank wall.

7. The rake classifier of claim 1 wherein said means for driving said drive shafts in synchronism comprises a first sprocket mounted on said motor shaft, a second sprocket mounted on a bearing shaft element of the other of said drive shafts and a drive chain engaging said sprockets.

8. The rake classifier of claim 7 wherein idler sprockets engaging said drive chain are provided between said first and second sprockets to assure synchronous action of said drive shafts.

9. A rake classifier comprising a tank having side and end walls, a rake structure, an electric motor having a motor shaft and motor-driven means for imparting raking movement to said rake structure, said rake structure positioned in said tank and having two pairs of upstanding hanger elements spaced along the length of said rake structure, said motor driven means comprising a driven slot in each hanger element with the slots of each pair aligned, a plurality of supporting guide surfaces provided on the walls of said tank with one of said guide surfaces adjacent each hanger element, wheel means at the upper end of each hanger element for contacting said supporting guide surfaces, a drive shaft for each pair of hanger elements passing through said aligned driven slots of the paired hanger elements, rollers mounted on said drive shafts and positioned in said driven slots, a crank element provided on each end of said driven shafts, a plurality of bearing shafts fixed in said side walls, one of said crank elements joining a first of said drive shafts to said motor shaft with the crank element at the other end thereof joining said first drive shaft to a bearing shaft, the second of said drive shafts connected at both ends thereof to crank elements which are connected to bearing shafts mounted in said side walls, and means for driving said drive shafts in synchronism comprising a first sprocket on said motor shaft, a second sprocket mounted on one of said bearing shafts associated with said second drive shaft and a drive chain engaging said sprockets.

* * * * *